United States Patent [19]

Hill

[11] Patent Number: 4,505,642

[45] Date of Patent: Mar. 19, 1985

[54] ROTOR BLADE INTERPLATFORM SEAL

[75] Inventor: Edward C. Hill, Tequesta, Fla.

[73] Assignee: United Technologies Corporation, Hartford, Conn.

[21] Appl. No.: 544,933

[22] Filed: Oct. 24, 1983

[51] Int. Cl.[3] ..... F01D 5/22

[52] U.S. Cl. ..... 416/193 A; 416/500

[58] Field of Search ..... 416/193 A, 220 R, 500

[56] References Cited

U.S. PATENT DOCUMENTS

| | | | |
|---|---|---|---|
| 3,266,771 | 8/1966 | Morley | 416/193 A X |
| 3,752,598 | 8/1973 | Bowers et al. | 416/220 X |
| 3,841,792 | 10/1974 | Amos | 416/221 X |
| 3,936,230 | 2/1976 | Helmintoller et al. | 416/193 R |
| 4,029,436 | 6/1977 | Shoup et al. | 416/221 X |
| 4,177,013 | 12/1979 | Patterson et al. | 416/193 A |
| 4,183,720 | 1/1980 | Brantley | 416/193 A |
| 4,326,835 | 4/1982 | Wertz | 416/193 A |
| 4,422,827 | 12/1983 | Buxe | 416/193 A |
| 4,455,122 | 6/1984 | Schwarzmann et al. | 416/193 A X |
| 4,457,668 | 7/1984 | Hallinger | 416/193 A X |

FOREIGN PATENT DOCUMENTS

| | | | |
|---|---|---|---|
| 697702 | 11/1964 | Canada | 416/221 |
| 2658345 | 6/1978 | Fed. Rep. of Germany | 416/193 A |
| 836371 | 6/1981 | U.S.S.R. | 416/193 A |

*Primary Examiner*—Everette A. Powell, Jr.
*Attorney, Agent, or Firm*—Stephen E. Revis

[57] ABSTRACT

A sheet metal seal for sealing the gap between adjacent blade platforms in a rotor assembly fits within a pair of spaced apart slots on the underside of one of the platforms and is trapped in position by a lug disposed between the slots and which passes through a hole in the seal. The seal is attached to the blade prior to its assembly in the disk. A portion of the seal overhangs the edge of the platform to which it is attached and, when the blade is inserted into the disk, the extended portion of the seal overlies the underside surface of the adjacent blade platform. This seal is preliminarily shaped to the contour of those portions of the underside surfaces of the platforms against which they are to bear during rotation of the assembly.

5 Claims, 3 Drawing Figures

ROTOR BLADE INTERPLATFORM SEAL,

The Government has the rights in this invention pursuant to Contract No. F33657-82-C-0001 awarded by the Department of the Air Force.

TECHNICAL FIELD

This invention relates to rotors, and more particularly to blade root seals for rotors.

BACKGROUND ART

It is well known to provide seals along the gap between adjacent blade platforms in a rotor, such as for a gas turbine engine, to prevent the escape of gas from the flow path. These seals are disposed between the disk rim and the underside of the blade platforms within a compartment formed between adjacent blades and bridge the gap between the two platforms along a substantial portion of the length of such gap. The seals may be thin, flat sheet metal which, under centrifugal loads during rotation of the rotor, conform to the undersurface of the platforms and seal along the gap therebetween. One such seal is shown in commonly owned U.S. Pat. No. 3,752,598, Bowers et al (see FIG. 5 thereof).

Improvements to this type of seal are continuously being sought. Ease of assembly and disassembly of the rotor and the seals, simplicity, low cost, reliability, and assurance that the seal is always properly positioned are some of the primary considerations.

DISCLOSURE OF INVENTION

One object of the present invention is an improved interplatform seal for rotors.

Another object of the present invention is a lightweight interplatform seal which is easily assembled into the rotor.

A further object of the present invention is an interplatform seal which is assured of being properly located within a rotor assembly at all times.

According to the present invention, a sheet metal seal is disposed along the underside of adjacent blade platforms in a rotor, bridging the gap between adjacent platform edges and sealing the gap, the seal being attached to one of the blade platforms by having a portion of the seal fit within at least one slot on the underside of the platform with a lug passing through an opening in the seal adjacent the slot to retain the seal within the slot. Preferably each blade has a pair of axially spaced apart slots with the retaining lug disposed therebetween.

The seal of this invention is advantageously secured to a blade before the blade is inserted in the disk. Preferably the shape of the sheet metal seal is similar to the shape of the undersurface of the platforms against which it will bear during operation. When the seal is attached to the one blade by means of the slots and lug, a portion of the seal extends beyond the edge of the platform. When the blade and seal assembly is inserted into the disk, this extended portion of the seal will slide under the platform of an adjacent blade already disposed in the disk, and will bridge the gap between the edges of the adjacent blade platforms.

When completely assembled, all of the seals are held in close proximity to the undersurfaces of the platforms along the gap which they are to seal whether or not the rotor is rotating. Individual blades may be easily removed from the disk, and the seal will remain attached thereto until removed by hand or special tool. The seal retaining slots and lug are preferably constructed such that the seal is secured with a sufficient degree of looseness to aid assembly of the blades into the disk and to permit the seal to seat itself properly under the action of centrifugal force.

The foregoing and other objects, features and advantages of the present invention will become more apparent in the light of the following detailed description of the preferred embodiments thereof as shown in the accompanying drawings.

BEST MODE FOR CARRYING OUT THE INVENTION

Figure 1:
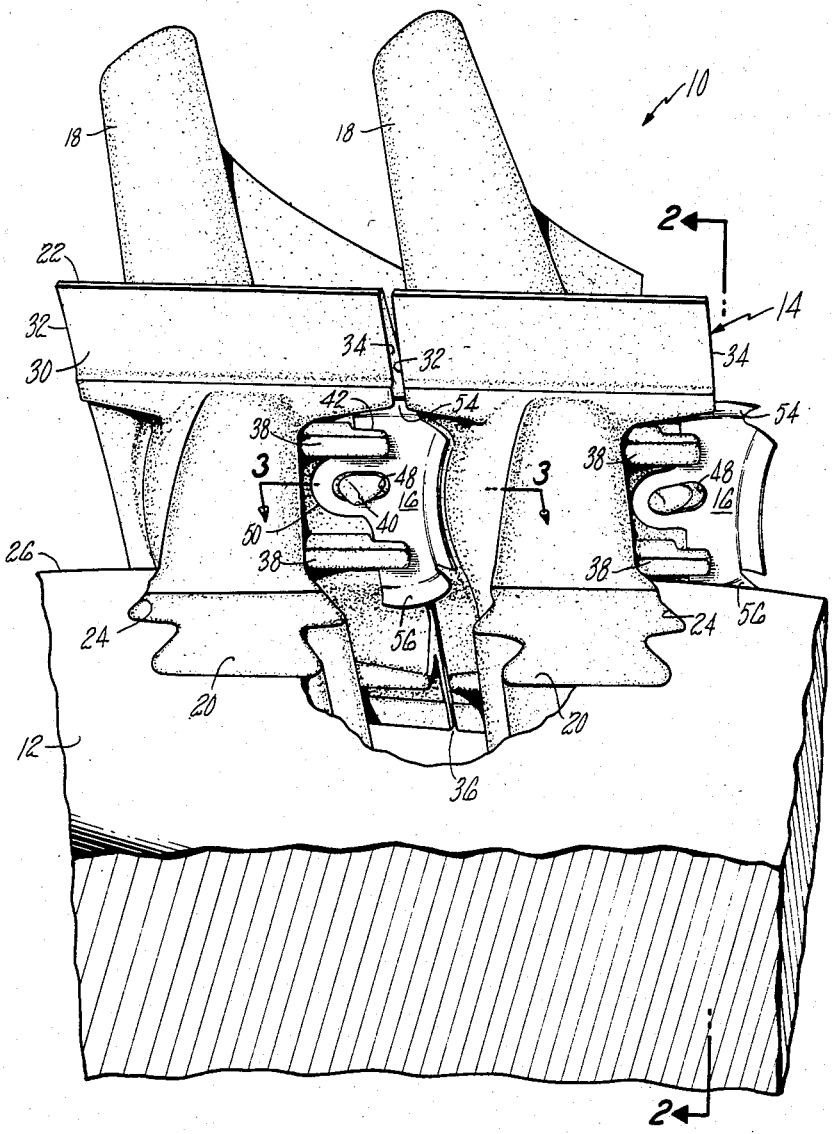
FIG. 1 is a perspective view of a portion of a turbine rotor which incorporates the present invention.

As an exemplary embodiment of the present invention, consider the portion of the turbine rotor assembly 10 shown in perspective in FIG. 1. The rotor assembly 10 comprises a disk 12, a plurality of blades 14, and a plurality of blade root seals 16. Each blade 14 includes an airfoil 18, a root 20, and a platform 22. The roots 20, in this embodiment, are dovetail shaped and fit into axially extending root slots 24 circumferentially spaced about the periphery 26 of the disk 12.

Each platform 22 includes a radially outwardly facing upper surface 28 (FIG. 2), a radially inwardly facing undersurface 30, and a pair of axially extending, oppositely facing edges 32, 34. The edge 34 of one platform is adjacent, closely spaced from, and aligned with the edge 32 of an adjacent platform defining a narrow gap 36 (FIG. 3) therebetween. A significant portion of the gap 36 is sealed to prevent leakage therethrough by means of the seals 16 disposed against portions of the underside surfaces 30 of the platforms 22 adjacent the edges 32, 34. Each seal is secured to one of the blades by means to be hereinafter described.

Figure 2:
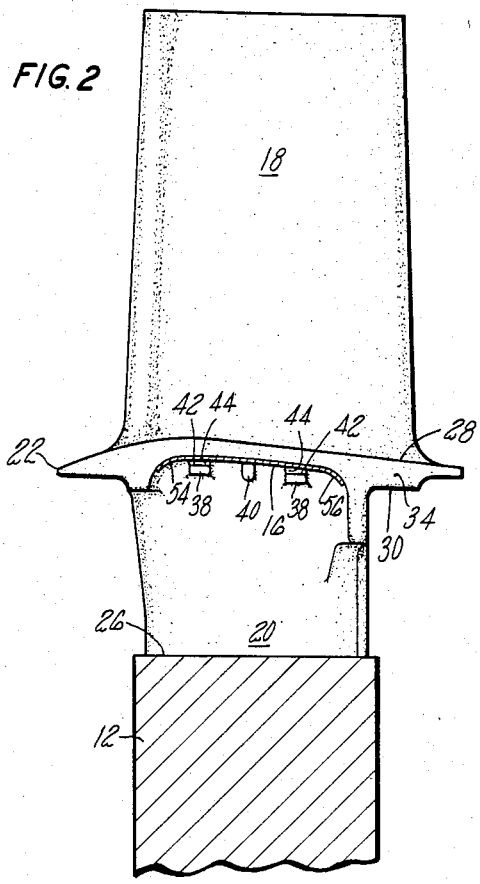
FIG. 2 is a sectional view taken along the line 2—2 of FIG. 1.
Figure 3:
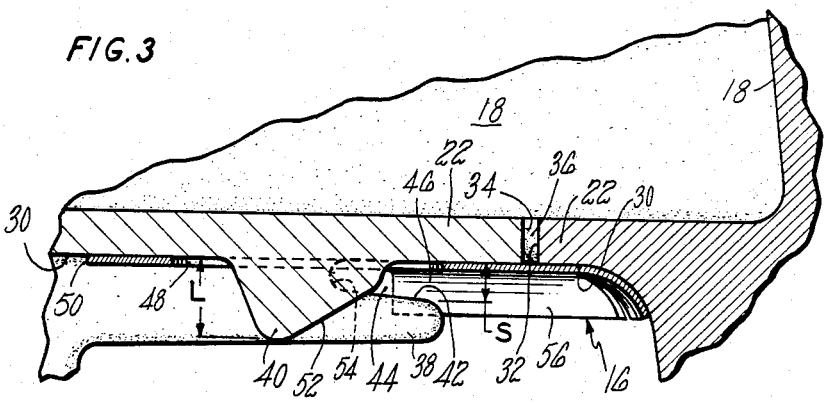
FIG. 3 is an enlarged sectional view taken along the line 3—3 of FIG. 1.

Referring to FIGS. 1 through 3, each seal 16 is attached to the underside surface 30 of a blade platform 22 by means of a pair of axially spaced apart tangs 38 and a radially inwardly extending lug 40 disposed between the tangs. The tangs 38 are integral with the undersurface 30 of the platform 22 and include a radially outwardly facing surface 42 closely spaced from the undersurface 30 to define a pair of axially spaced apart seal slots 44, each having an opening 46 (FIG. 3) facing in the direction of the edge 32 of the adjacent blade platform. A first portion of the seal 16 fits under the tangs 38 within the slots 44 and has an opening 48 therethrough through which the lug 40 extends. Such first portion is contoured to substantially the shape of the underside surface 30 which it overlies. The maximum radial height "L" of the lug 40 from the undersurface 30 is slightly greater than the maximum height "S" of the slots 44. A portion of each seal 16 bridges the gap 36 between adjacent platforms and overlies and is contoured to substantially the shape of a portion of the underside surface 30 of the adjacent blade platform 22.

Each seal 16 is secured to its respective blade 14 before the blade is inserted into the disk 12. This is done by inserting the seal 16 into the slots 44 until the lug 40 enters the opening 48. Because the height L of the lug 40 is greater than height S of the slot 44, the seal 16 will bend slightly as it is inserted until the lug 40 snaps through the opening 48. The side 52 of the lug 40 facing the edge 34 slopes downwardly toward the edge 34 for ease of moving the back edge 50 of the seal 16 over the lug 40. The opening 48 is only slightly larger than the base of the lug 40 to restrict circumferential and axial motion of the seal 16 once it is in place. The height S of the slots 44 permit some radial movement of the seal 16; however, it cannot, on its own, fall out of the slot due to the fact that the height of the lug 40 is greater than the height of the slots 44.

Once a seal 16 has been attached to the blade platform, the blade root 20 is inserted into a disk slot 24. The radial looseness of the seal and its ability to bend resiliantly allows the portion of the seal overhanging the platform edge 34 to slide under the platform of an adjacent blade which is already disposed in the disk 12. The side portions 54, 56 (FIG. 2) of the seals 16 are preferably curved radially inwardly to further facilitate assembly and removal of the blades with seals attached. When the rotor is fully assembled, the seals 16 are located in close approximation to their correct sealing position, even when the rotor assembly 10 is not rotating. Because the seals are slightly loosely held by the tangs 38 and lug 40, upon rotation of the rotor assembly 10 they are able to shift into their precisely correct position whereby they mate with the appropriate portions of the undersurfaces 30 of the adjacent blade platforms. Preferably, the seal 16 is thin enough such that centrifugal forces will eliminate any remaining mismatch.

Although the invention has been shown and described with respect to a preferred embodiment thereof, it should be understood by those skilled in the art that various changes and omissions in the form and detail thereof may be made therein without departing from the spirit and scope of the invention.

I claim:

1. A rotor assembly comprising:

a disk having a rim and an axis, said rim including root slot means;

a plurality of blades, each having a root disposed in said root slot means, wherein said blades are circumferentially and uniformly spaced about the periphery of said disk, each blade having a platform spaced radially outwardly of said rim, each platform having a first and second axially extending edge, said first edge of each platform being adjacent and aligned with said second edge of the platform of an adjacent blade defining a narrow gap therebetween, each platform also having a radially inwardly facing first undersurface portion adjacent said first edge and second undersurface portion adjacent said second edge, each blade including slot forming means having radially outwardly facing surfaces closely spaced from and facing said first undersurface portion of its respective blade defining at least one seal slot therebetween, said seal slot having an opening facing in the direction of said first edge of its respective blade platform, said platform including a lug adjacent said seal slot and extending radially inwardly from said first undersurface portion of said platform; and a sheet metal seal between each pair of adjacent blades, each seal having a first portion contoured to substantially the shape of said first undersurface portion of one of said pair of blades and overlying the said first undersurface portion, said seal first portion being disposed within said seal slot of said one of said blades and having an opening therethrough through which said lug extends, wherein said lug traps said seal within said seal slot, said seal also having a second portion extending beyond said first edge and contoured to substantially the shape of said second undersurface portion of said blade platform of said other one of said pair of blades, wherein said trapped seal bridges the gap between said adjacent platform edges of said pair of blades such that said seal second portion overlies said second portion of said platform of said other one said pair of blades.

2. The rotor assembly according to claim 1 wherein the height of said lug is greater than the height of said slot openings.

3. The rotor assembly according to claim 2 wherein said slot forming means defines a pair of axially spaced apart seal slots, and said lug is disposed between said pair of seal slots.

4. The rotor assembly according to claim 3 wherein said seals each include side portions curved radially inwardly.

5. The rotor assembly according to claim 4 wherein said slot forming means is a pair of axially spaced apart tangs, each tang defining one of said pair of seal slots.

* * * * *